United States Patent [19]

Jones

[11] Patent Number: 4,689,097

[45] Date of Patent: Aug. 25, 1987

[54] CO-OXIDIZERS IN SOLID CROSSLINKED DOUBLE BASE PROPELLANTS (U)

[75] Inventor: Marvin L. Jones, Cumberland, Md.

[73] Assignee: Hercules Incorporated, Wilmington, Del.

[21] Appl. No.: 529,811

[22] Filed: Aug. 22, 1983

[51] Int. Cl.[4] ..... C06B 45/02

[52] U.S. Cl. ..... 149/21; 149/85; 149/92; 149/93; 149/98; 149/111

[58] Field of Search ..... 149/21, 85, 92, 93, 149/98, 111

[56] References Cited

U.S. PATENT DOCUMENTS

| | | | |
|---|---|---|---|
| 3,909,324 | 9/1975 | Niles | 149/85 X |
| 3,971,681 | 7/1976 | Rains et al. | 149/98 X |
| 4,113,811 | 9/1978 | Helfgen et al. | 149/92 X |
| 4,172,743 | 10/1979 | Goddard | 149/92 X |

*Primary Examiner*—Stephen J. Lechert, Jr.
*Attorney, Agent, or Firm*—Edmund C. Ross, Jr.

[57] ABSTRACT

Use of mixtures of certain solid oxidizers in minimum smoke crosslinked propellants dramatically enhances burn rates.

8 Claims, No Drawings

CO-OXIDIZERS IN SOLID CROSSLINKED DOUBLE BASE PROPELLANTS (U)

BACKGROUND OF THE INVENTION

This invention relates to the use of mixtures of oxidizers in minimum-smoke crosslinked double base (XLDB) propellants whose particle sizes can be adjusted for the specific purpose of dramatically increasing the burning rate of the propellant.

High performance solid rocket propellants with a minimum visible signature, or minimum smoke, can be manufactured by combining solid oxidizer and binders that contain only the elements carbon, hydrogen, nitrogen, and oxygen. Oxidizer include but are not limited to cyclotrimethylenetrinitramine (RDX), cyclotetramethylenetetranitramine (HMX), pentaerythritol tetranitrate (PETN) and ammonium nitrate (AN), with RDX and HMX being the most common oxidizers used because of their increased performance when compared to other oxidizers. Binders consist of mixtures of polymers that can be crosslinked during cure and nitro and nitrate ester plasticizers. Typical polymers include but are not limited to poly(ethylene glycol adipate) (PGA), polycaprolactone (PCP), and poly(ethylene glycol) (PEG) with hydroxyl functionality between two and three. These polymers are cured with a combination of (1) polyfunctional alcohols such as nitrocellulose (12.2% nitrogen) (NC), butane triols, and hexane triols and (2) polyfunctional isocyanates such as hexamethylene diisocyanate (HDI), isophorone diisocyanate (IPDI), toluene diisocyanate (TDI) and aliphatic polyisocyanates such as Mobay N-100® with an isocyanate functionality between 3 and 4. Typical nitro and nitrate ester plasticizers include but are not limited to one or more liquids such as a 1/1 mixture of bis-dinitropropyl acetyl (BDNPA) and bis-dinitropropyl formal (BDNPF), nitroglycerin (NG), butane triol trinitrate (BTTN), trimethylol ethane trinitrate (TMETN) and tri(ethylene glycol)dinitrate (TEGDN), with NG and BTTN being the most common plasticizers used because of their increased performance when compared to other plasticizers. Small quantities of stabilizers are added to increase the useful life, or shelf life, of these propellants. Typical stabilizers include but are not limited to 2-nitrodiphenylamine (DNPA), N-methyl-p-nitroaniline (MNA), and 1,3-bis(N-methyl-phenyl urethane)benzene (BMUB).

It is very difficult to tailor the burning rate of minimum smoke XLDB propellants. Varying the RDX or HMX particle size has very little effect on propellant particle burning rates. Small particle size, 10 to 20 microns weight-medium-diameter, oxidizer is generally used because the resulting propellant will have better mechanical properties than a propellant with large oxidizer. Burning rate can be varied some by changing the binder energy. However, this technique is limited because this change will either reduce performance or reduce mechanical properties.

Propellant burning rates can be varied over the range of 0.2 in/sec to 0.5 in/sec at 1000 psi using the methods described above and by the addition of small quantities of lead and tin salts with carbon black. Typical lead and tin salts include but are not limited to lead citrate (PbCit), lead salicylate (PbSal), lead sebacate (PbSeb), lead oxides (PbO, $Pb_2O_3$), tin citrate (SnCit), and lead stannate ($PbSnO_4$) with PbCit being the most common lead salt used in minimum-smoke XLDB propellants. Generally less than three percent PbCit is employed and the amount of primary smoke generated by this lead in the rocket exhaust is minimal. The combustion characteristics of minimum-smoke propellants containing HMX are almost identical to propellants containing RDX.

BRIEF SUMMARY OF THE INVENTION

This invention provides means for increasing the burning rate of minimum smoke, crosslinked, double base propellants through selecting oxidizer and particle size thereof and, more particularly through selecting for the solid oxidizer coarse particles of nitramine oxidizer and fine particles of triaminoguanidium (TAG-N) nitrate. The ratio of the weight mean diameter of the fine particles to the coarse particles is preferably between about 1:10 and 1:60 and the coarse particles have a weight mean diameter above about 100 microns.

DETAILED DESCRIPTION OF THE INVENTION

Examples

The examples given here demonstrate how TAGN and RDX particle sizes can be used to tailor minimum-smoke XLDB propellant burning rates. These examples are shown in Table 1. Burning rates were obtained in every example by burning nominal ¼-inch diameter×3-inch long strands in a nitrogen-pressurized burning-rate bomb. The burning rates were calculated from the time required to burn a known distance, usually 2.5 inches, of propellant at a given pressure. Duplicate strands were burned at each pressure. Burning rates were also obtained in 2.5-inch diameter×4-inch long rocket motors for two examples.

A typical mix procedure for these propellants is as follows: the nitrocellulose, mixture of plasticizer, polymers (such as PGA, PCP or PEG) and stabilizers are mixed together at 140° F. for three days to form a lacquer premix. The lacquer premix is transferred to the propellant mix bowl into which the solids (HMX, RDX, TAGN) are added incrementally with mixing at 90°–110° F. The ballistic modifiers and cure catalyst are then added and the slurry is vacuum mixed for one-hour. The crosslinker is then added and the slurry is vacuum mixed for 10 to 20 minutes at 90°–110° F. The propellant is then case and cured for 7–10 days at 120° F.

(U) TABLE 1

(U) Burning Rates of Selected Minimum Smoke Propellants

| | Propellant Number | | | | | | | |
|---|---|---|---|---|---|---|---|---|
| | 1 | 2 | 3 | 4 | 5 | 6 | 7 | 8 |
| | Mix Number | | | | | | | |
| | IBPS-5109 | IBPS-5230 | IBPS-5124 | IBPS-4902 | IBPS-3006 | IOBPS-695 | IOBPS-733 | IBPS-5424 |
| Ingredients | | | | | | | | |
| Binder (Wt, %) | 35 | 35 | 35 | 35 | 35 | 35 | 35 | 35 |

(U) TABLE 1-continued

| (U) Burning Rates of Selected Minimum Smoke Propellants | | | | | | | | |
|---|---|---|---|---|---|---|---|---|
| | Propellant Number | | | | | | | |
| | 1 | 2 | 3 | 4 | 5 | 6 | 7 | 8 |
| | Mix Number | | | | | | | |
| | IBPS-5109 | IBPS-5230 | IBPS-5124 | IBPS-4902 | IBPS-3006 | IOBPS-695 | IOBPS-733 | IBPS-5424 |
| RDX (Wt, %) | 62 | 37 | 37 | 42 | 42 | 37 | 37 | 43 |
| Size in micron | 15 | 35 | 15 | 35 | 35 | 150 | 150 | 150 |
| TAGN (Wt, %) | 0 | 25 | 25 | 20 | 20.0 | 25 | 25 | 25 |
| Size in micron | — | 12 | 3 | 3 | 3 | 2.3 | 3.2 | 3.2 |
| PbSalt | PbCit | PbCit | PbCit | PbCit | PbSal | PbCit | PbCit | None |
| Burning Rate Strands, in/sec | | | | | | | | |
| at 1000 psi | 0.499 | 0.57 | 0.64 | 0.54 | 0.54 | 1.08 | 0.84 | 0.78 |
| at 2000 psi | 0.628 | 0.82 | 0.95 | 0.78 | — | 1.68 | 1.33 | — |
| 2.5 × 4" Motors | | | | | | | | |
| Pressure, psi | — | — | — | — | — | 1233 | 2033 | — |
| Rate, in/sec | — | — | — | — | — | 1.29 | 1.40 | — |
| Pressure, psi | — | — | — | — | — | 2636 | 2732 | — |
| Rate, in/sec | — | — | — | — | — | 1.81 | 1.14 | — |

The first example shows the burning rate of a state-of-the-art minimum smoke propellant containing 15 micron RDX as the only oxidizer. This propellant has been manufactured and cast into hundreds of tactical rocket motors. The burning rate of just under 0.5 in/sec at 1000 psi is one of the highest of any minimum-smoke propellant used in production rocket motors.

The second example shows the effect of adding 25% 12 micron TAGN. The RDX size was raised to 35 micron to facilitate mixing (lower mix slurry viscosity). The burning rate increased almost 15% due to this change.

The third example shows the effect of adding 25% 3 micron TAGN and maintaining the fine RDX size. The strand burning rate was 25 to 30 percent faster than the baseline (example 1) and shows an effect of the TAGN size on burning rate.

The fourth example shows the effect of changing the TAGN content. Less TAGN results in a lower burning rate.

The fifth example shows that the burning rate of minimum-smoke propellants containing TAGN and RDX co-oxidizers can be maintained with a lead salt other than PbCit.

The sixth and seventh examples show the dramatic increase in burning rate obtained when the fine RDX is replaced with coarse RDX in propellants containing fine TAGN. These examples also show the effect of TAGN size on burning rate, smaller TAGN giving a higher burning rate.

The eighth example shows that the high burning rate obtained with fine TAGN and coarse RDX is maintained even when PbCit is not present. The PbCit, or other lead salts, is required to produce the burning rate of the baseline propellant.

What I claim is:

1. In a minimum smoke, crosslinked, double base propellant consisting essentially of solid oxidizer and binder consisting of elements selected from carbon, hydrogen, nitrogen and oxygen, the improvement wherein said solid oxidizer comprises (a) fine triaminoguanidium nitrate particles and (b) coarse nitramine particles, the ratio between the weight mean diameter of said fine particles to said coarse particle being at least about 1:10 and said coarse particles having a weight mean diameter greater than one hundred microns.

2. The improved propellant in accordance with claim 1, wherein said nitramine oxidizer comprises trimethylenetrinitramine.

3. The improved propellant in accordance with claim 1, wherein said nitramine oxidizer comprises cyclotetramethylenetetranitramine.

4. The improved propellant in accordance with claim 1, wherein (a) comprises between between about 32 and 39 percent by weight of said solid oxidizer.

5. The improved propellant in accordance with claim 1, wherein (b) comprises between about 61 and 68 percent by weight of said solid oxidizer.

6. The improved propellant in accordance with claim 1, wherein the burning rate is over about 1 inch per second.

7. The improved propellant in accordance with claim 1, which further comprises a metal salt.

8. In a minimum smoke, crosslinked, double base propellant consisting essentially of solid oxidizer and binder consisting of elements selected from carbon, hydrogen, nitrogen and oxygen, the improvement wherein said solid oxidizer consists essentially of fine and coarse oxidizer particles wherein the weight mean diameter of said coarse oxidizer particles is greater than 100 microns and the ratio of the weight mean diameter of said fine particles to said coarse particles being between about 1:10 and 1:60, said fine oxidizer particles consisting of triaminoguanidium nitrate and said coarse oxidizer particles selected from trimethylenetrinitramine and cyclotetramethylenetetranitramine.

* * * * *

UNITED STATES PATENT AND TRADEMARK OFFICE

CERTIFICATE OF CORRECTION

PATENT NO. : 4,689,097

DATED : August 25, 1987

INVENTOR(S) : JONES

It is certified that error appears in the above-identified patent and that said Letters Patent is hereby corrected as shown below:

Column 1, Line 46

"(DNPA)" should be --(NDPA)--

Column 4, Line 37

"between between" should be --between--.

Signed and Sealed this

Twenty-ninth Day of December, 1987

*Attest:*

DONALD J. QUIGG

*Attesting Officer*

*Commissioner of Patents and Trademarks*